US007471050B2

(12) United States Patent
Shimada et al.

(10) Patent No.: US 7,471,050 B2
(45) Date of Patent: Dec. 30, 2008

(54) ORGANIC EL DRIVE CIRCUIT AND ORGANIC EL DISPLAY DEVICE

(75) Inventors: Yuji Shimada, Kyoto (JP); Masanori Fujisawa, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 178 days.

(21) Appl. No.: 10/582,631

(22) PCT Filed: Dec. 13, 2004

(86) PCT No.: PCT/JP2004/018560

§ 371 (c)(1),
(2), (4) Date: Jun. 12, 2006

(87) PCT Pub. No.: WO2005/057543

PCT Pub. Date: Jun. 23, 2005

(65) Prior Publication Data

US 2007/0115222 A1 May 24, 2007

(30) Foreign Application Priority Data

Dec. 12, 2003 (JP) ..... 2003-414168

(51) Int. Cl.
*G05F 1/00* (2006.01)

(52) U.S. Cl. ..... 315/291; 315/169.1; 315/169.2; 315/312; 315/360; 345/76; 345/84; 345/204; 345/690

(58) Field of Classification Search ... 315/169.1–169.3, 315/291, 312, 360, 294, 362; 345/45, 76, 345/83, 84, 204, 205, 690
See application file for complete search history.

(56) References Cited

U.S. PATENT DOCUMENTS 7,129,916 B2 * 10/2006 Maede et al. ..... 345/76
7,292,234 B2 * 11/2007 Kitahara ..... 345/204

FOREIGN PATENT DOCUMENTS

| | | |
|---|---|---|
| JP | 50-51692 | 8/1975 |
| JP | 3-157690 | 7/1991 |
| JP | 9-232074 | 9/1997 |
| JP | 10-207436 | 8/1998 |

(Continued)

*Primary Examiner*—Haissa Philogene
(74) *Attorney, Agent, or Firm*—Mattingly, Stanger, Malur & Brundidge, PC

(57) ABSTRACT

To provide an organic EL drive circuit and an organic EL display device using the organic EL drive circuit, which, when grey levels of passive matrix type organic EL elements are controlled time-divisionally, is capable of easily collecting luminance in low luminance level with low drive voltage and restricted power consumption.
[Means for Resolution]

An organic EL drive circuit, which has a plurality of current drive circuits for generating PWM pulse having pulse width corresponding to display data of luminance of organic EL elements and outputting a drive current for driving the organic EL elements for a time period corresponding to the PWM pulse, comprises a peak current generator circuit for generating a peak current on the drive current. The current drive circuit is provided for each of the output pins connected to the respective organic EL elements and generates the peak currents larger than the drive current corresponding to the display data when the display data value indicates a predetermined luminance or lower.

7 Claims, 3 Drawing Sheets

FOREIGN PATENT DOCUMENTS

| | | |
|---|---|---|
| JP | 11-45071 | 2/1999 |
| JP | 2001-109421 | 4/2001 |
| JP | 2001-143867 | 5/2001 |
| JP | 2001-296837 | 10/2001 |
| JP | 2003-280605 | 10/2003 |

* cited by examiner

10
+20V
+Vcc
1
X m
X3
X2
X1
14
12
CLOCK GENERATOR CIRCUIT
11
MPU
CLK
TO GREY LEVEL REGULATION DATA REGISTER 4a
DATA
S2
S1
13
DATA/LIGHT EMITTING TIME DATA CONVERTER ROM
10a
10b
10c
10d
D1
7a
6a
5
n x I
I
Tr2
7
P
Tr1
6
1
LIGHT EMITTING TIME DATA REGISTER
3
< CURRENT DRIVE CIRCUIT >
2
< PWM DRIVE CIRCUIT >
2b
COM
2a
COUNTER
< PEAK CURRENT CONTROL CIRCUIT >
ONE-SHOT CIRCUIT
4c
4b
4
D2
GREY LEVEL REGULATION DATA REGISTER
4a
<IC>

ORGANIC EL DRIVE CIRCUIT AND ORGANIC EL DISPLAY DEVICE

TECHNICAL FIELD

The present invention relates to an organic EL drive circuit and an organic EL display device and, in particular, the present invention relates to an improvement of an organic EL drive circuit for controlling grey level of passive matrix type organic EL elements time-divisionally by PWM correspondingly to luminance thereof such that the organic EL element can be driven with low voltage while restricting power consumption thereof and correcting luminance in low luminance display easily and an organic EL display device using the same organic EL drive circuit.

BACKGROUND ART

Since an organic EL display device can perform high luminance display by spontaneous light, the organic EL display device is suitable for small display screen. Therefore, the organic EL display device is paid attention as the next generation display device to be mounted on such as a portable telephone set, a DVD player, a PDA (personal digital assistance). An organic EL element (referred to as "OEL element", hereinafter) is current driven in order to solve the problem of luminance variation.

In an organic EL display panel of the organic EL display device for a portable telephone set having the number of terminal pins corresponding to 396 (=132×3) column lines and the number of terminal pins corresponding to 162 row lines has been proposed and the numbers of the terminal pins for the column lines and the row lines tend to be increased.

The OEL element has capacitive load characteristics. Therefore, when a positive matrix type OWL element is current-driven, a peak current is generated to initially charge the OEL element and a current drive circuit having a current output stage for generating a peak current is known (Patent Reference 1). The luminance control, that is, the grey level control, of an OEL element in such kind of current drive circuit is performed by controlling a drive current.

On the other hand, in an active matrix type organic EL drive circuit, a capacitor of a pixel circuit stores a drive current as a voltage value and there are various systems therefor. One of these systems is the time-division grey level control system. When the number of bits for grey control is, for example, 6 in the time-division grey level control system, one frame is divided to 6 sub frames having different drive times and the grey level control is performed time-divisionally by driving the OEL elements in predetermined time periods obtained by combining 6 sub frames in the frame corresponding to grey levels at a constant voltage. That is, the luminance is controlled by not the drive current value but the drive time.

An OEL element drive circuit, in which OEL elements arranged in matrix are current driven and are reset by grounding anodes and cathodes of the OEL elements is disclosed in Patent Reference 2. Further, a technique for current driving OEL elements with low power consumption by using a DC-DC converter is disclosed in Patent Reference 3.

Patent Reference 1: JPH11-45071A
Patent Reference 2: JPH9-232074A
Patent Reference 3: JP2001-143867A

DISCLOSURE OF THE INVENTION

Problem that the Invention is to be Solved

When the grey level control of the passive matrix type OEL element is performed according to current value, it is necessary to maintain an amount of current enough to emit light corresponding to maximum luminance. Therefore, values of not only voltage but also current must be large and it is difficult to restrict an increase of power consumption correspondingly.

In order to restrict power consumption, it may be considered that the time-divisional grey level control for the active matrix type OEL element is applied to the passive matrix type OEL element driving to perform PWM grey level control. There may be no severe problem in luminance of low grey level when the grey level control of about 4 bits in the PWM grey level control is performed. However, when the grey level control with 6-bit or more is performed, a display image is collapsed because difference in grey level in the low grey level portion disappears. In order to avoid such problem, it is necessary to increase the drive current.

As a result, though a total current for one frame display can be reduced compared with the grey level control using only current when the grey level control of 6 bits or more is performed in the grey level control using PWM, a power source voltage of 25V or higher is necessary due to the problem of the difference in grey level in the low level portion, so that the reduction of power consumption can not be achieved.

The present invention is intended to solve the problem of the prior art and an object of the present invention is to provide an organic EL drive circuit or an organic EL display device, with which a luminance correction in low luminance is easy in a case of grey level control of passive matrix type OEL element with low voltage drive while restricting power consumption.

Means for Solving the Problem

An organic EL drive circuit of the present invention includes a current drive circuit for driving each of organic EL elements by generating PWM pulses having pulse width corresponding to a display data, which corresponds to luminance of the organic EL element, and outputting a drive current for a time corresponding to the width of the PWM pulse and peak current generator circuits for generating peak currents on the drive currents. The current drive circuit is provided for each of output pins connected to the organic EL elements and, when a value of the display data indicates a predetermined luminance or a value lower than the predetermined luminance, the peak current generator circuit generates a peak current larger than the drive current corresponding to the display data.

Advantage of the Invention

According to the present invention, the luminance of the OEL element is controlled by the pulse width of the PWM pulse and it is possible to make the difference in grey level larger in a region, in which the difference in grey level is not clear in the low grey level portion, by the peak current generator circuit for grey level correction.

Therefore, since, when the OEL element is driven in a luminance equal to of lower than the predetermined value, the peak current is generated in addition to the drive current by the PWM pulse so that the OEL element is initially charged or initially emitting light by the sum of the peak current and the drive current, there is no collapse of luminance with the display data value with which the luminance difference on a display screen and the luminance correction for emphasizing luminance.

As a result, when the grey level control for determining intensity of luminance by determining a drive time of the passive matrix type OEL element by the width of the PWM pulse, it is possible to drive the OEL element with low voltage while restrict power consumption.

BEST MODE FOR CARRYING OUT THE INVENTION

FIG. 1 is a block circuit diagram of a current drive circuit of an organic EL drive circuit according to an embodiment of the present invention, FIG. 2 is a timing chart of a PWM drive and FIG. 3 is a graph showing grey level characteristics with respect to a display data in a PWM grey level control.

In FIG. 1, a reference numeral 10 depicts a column driver of an organic EL drive circuit and a current drive circuit 1 is provided correspondingly to each of column side output pins X1, X2, X3 . . . Xm.

The current drive circuit 1 is constructed with a PWM drive circuit 2, a light emitting time data register 3 of 12 bits, a peak current control circuit 4 and an output stage current source 5. Incidentally, since the current drive circuits 1 shown in FIG. 1 have the same constructions connected to the other output pins are constructed, an internal circuit of only the current drive circuit 1 corresponding to the output pin X1 is shown.

The column driver 10 takes in the form of an IC and an MPU 11, a clock generator circuit 12 and a display data/light emitting time data converter 13 are provided externally of the IC. The clock generator circuit 12 outputs clock signals CLK to the MPU 11 and the PWM drive circuits 2 of the respective current drive circuits 1 and the light emitting time data register 3.

The display data/light emitting time data converter 13, which is a ROM in this embodiment, converts the display data DATA correspondingly to the respective output pins X1 to Xm sent from the MPU 11 into light emitting time data D1. The bit positions of the display data DATA are weighted from the least significant bit with increasing rate. The display data/light emitting time data converter 13 generates the weighted data D1. For example, the data D1 is converted into, for example, the least significant display data bit D00 weighted by ×1, a next significant display data bit D01 weighted by ×k1 and a next bit D02 weighted by ×k2 and so on. Therefore, the display data of K bits is converted into a light emitting time data of L bits (K<L). In this case, resolution of the light emitting time data of LLSB corresponds to the period t of the clock CLK.

For simplicity of description, it is assumed that the light emitting time data registers 3 are connected in series to construct a shift register. The serial data converted by the display data/light emitting time data converter 13 is inputted in the shift register. The light emitting time data D1 is inputted to initial one of the light emitting time data registers 3. The inputted light emitting time data D1 is sequentially shifted according to the clock CLK and set in the light emitting time data registers 3 of the respective current drive circuits 1 corresponding to the respective output pins. Therefore, length of the light emitting time data becomes (bit number of the light emitting time data D1)×(number of the output terminal pins).

Incidentally, it is possible to provide the light emitting time data registers 3 and the light emitting time data may be set in the respective registers.

The MPU 11 generates the display data DATA for the output pins X1 to Xm serially and control signals S1 and S2 and controls the respective circuits through the input terminals 10*c* and 10*d*. Incidentally, the control signal S2 is a display start signal for starting the display.

Further, the MPU 11 preliminarily sets grey level register data D2 in the grey level correction data registers 4*a* corresponding to the respective output pins. The grey level correction data register 4*a* is constructed with a non-volatile memory such as an EEPROM and the 4-bit data D2 selected correspondingly to luminance of the OEL elements 14 connected to the respective output pins X1 to Xm in the grey level correction data register 4*a* is set from the MPU 11 in a test stage when the product is shipped.

Incidentally, a reference numeral 14 depicts the OEL elements connected to the respective output pins X1 to Xm.

The PWM drive circuit 2 is constructed with a counter 2*a* and a digital comparator (COM) 2*b*. The counter 2*a* is reset by the control signal S2 to start a counting of the clock CLK from "0". The digital comparator 2*b* compares the value D1 of the light emitting time data registers 3 with the count value Cn of the counter 2*a* in response to the control signal S2 and generates an output "H" (=HIGH level) when the count value Cn of the comparator 2*b* is equal to or smaller than the value D1 of the light emitting time data register 3 or an output "L" (=LOW level) when the count value Cn is larger than the value D1. The output "H" or "L" is sent to the output stage current source 5. Thus, a PWM pulse ("H") having pulse width corresponding to the value D1 of the light emitting data register 3 is generated at an output of the digital comparator 2*b*.

The peal current control circuit 4 is constructed with the grey level correction data register 4*a*, a digital comparator (COM) 4*b* and a one-shot circuit 4*c* and is used for grey level correction by emphasizing luminance in a low luminance region. The digital comparator 4*b* compares the value D1 of the light emitting time data register 3 with the value D2 of the grey level regulation data register 4*a* at a timing of a rising edge of the control signal S2 and generates "H" (=HIGH level) when the value D1 of the light emitting time data register 3 is equal to or smaller than the value D2 of the grey level regulation data register 4*a* and "L" (=LOW level) when the D1 is larger than D2. The rising edge of the "H" output is a trigger signal of the one-shot circuit 4*c*. As a result, the one-shot circuit 4*c* generates an output signal "H" for a constant time period TP when the D1 is equal to or smaller than D2 and the output signal of the one-shot circuit 4*c* is supplied to the output stage current source 5. Incidentally, the constant time period TP is shorter than the drive period for initially charging the OEL element 14.

Incidentally, the peak current control circuit 4 may include an N channel MOSFET Tr2 of the output stage current source 5 to be described below.

The output stage current source 5 includes a series connection of a current output circuit 6*a* provided between a power source line +Vcc of about +20V and each of the output pins and an N channel MOSFET Tr1. Further, a peak current output circuit 7 is composed of a constant current source 7*a* and the N channel MOSFET Tr2, which is connected in parallel to the constant current source 6*a*.

The current value of the constant current source 6*a* is I and the current of the constant current source 7*a* is n×I, where n is an integer equal to or larger than 2.

The transistor Tr1 has a source connected to the output pin, a drain connected to the power source line +Vcc through the constant current source 6*a* and a gate supplied with the output of the digital comparator 2*b*. When the output of the digital comparator 2*b* is "H", the transistor Tr1 becomes ON and, when the output of the digital comparator 2*b* is "L", the transistor Tr1 becomes OFF.

The transistor Tr2 has a source connected to the drain of the transistor Tr1, a drain connected to the power source line +Vcc through the constant current source 7*a* and a gate supplied with the output of the one-shot circuit 4*c*. The transistor Tr2 becomes ON for only the constant period TP when the one-shot circuit 4*c* generates "H".

The MPU 11 generates the display data DATA of, for example, units of 6 bits (K=6) corresponding to the respective output pins sequentially and outputs the display data together with the control signal S1. The sequentially generated display data DATA of units of 6 bits is supplied to the display data/light emitting time data converter 13 and converted into the light emitting time data D1 of units of 12 bits (L=12). The converted light emitting time data is outputted sequentially and shifted by the shift register composed of the light emitting time data registers 3 at a predetermined timing to distribute the light emitting time data D1 to the light emitting time data registers 3 provided correspondingly to the output pins X1 to Xm. Incidentally, the number of stages of the shift register in this case is 12×m, where m is a total number of the output pins.

Therefore, the light emitting time data D1 are set in the light emitting time data registers 3 according to the control signal S1. Then, the MPU 11 generates the control signal S2 to drive the PWM drive circuit 2 and the peak current control circuit 4.

Incidentally, the grey level regulation data D2 has several bits. When the light emitting time data D1 is 12 bits, the grey level correction data D2 corresponds to the lower 4 bits of the 12 bits of the light emitting time data D1. Therefore, a value, which may be "1111" or thereabouts are preliminarily set in the grey level correction data register 4*a* correspondingly to the light emitting characteristics of the OEL elements.

Now, the current drive operation of the column driver of the organic EL drive circuit will be described with reference to FIG. 2.

It is assumed that the number (m) of the output pins is 132 and an internal shift clock of the light emitting time data register 3 is 12 times the clock CLK and data is shifted in units of 12 bits for 1 clock of the clock CLK. In response to the rising edge of the control signal S1, the 132 light emitting time data D1 (see FIG. 2(*a*)-(*c*)) corresponding to luminance are set in the light emitting time data registers 3, which correspond to the output pins X1 to Xm, serially.

When the light emitting time data registers 3 are provided independently, the 12-bit light emitting time data D1 is set in the respective light emitting time data registers 3 sequentially in synchronism with the clock CLK.

Next, as shown in FIG. 2(*d*), the comparison of the light emitting time data D1 with the rising edge of the control signal S2 (display start signal) is performed by the digital comparators 2*b* and 4*b* and the PWM pulse is generated in the drive period T (=D1×t), which is PWM controlled correspondingly to the value D1 of the light emitting time data, by the digital comparator 2*b* (see FIG. 2(*e*)), where t is the period of the clock CLK.

Simultaneously with this, when D1<=D2, that is, for example, when the value D1 of the light emitting time data is "000000001110" and is smaller than D2="1111" set in the output pin or D1=D2, the drive period T1 becomes shorter correspondingly to the value D1 as shown in FIG. 2(*c*). At this time, an output of the digital comparator 4*b* is generated simultaneously with the generation of the PWM pulse, so that the one-shot circuit 4*c* generates a pulse P having a period Tp (see FIG. 2(*f*)). Thus, current (1+n)·I flows in the period Tp from the rising edge of the control signal S2 and, therefore, current I flows in the period (T−Tp) (see FIG. 2(*g*)).

On the other hand, when D1>D2, for example, D1 is "000000001001" and D2 is "1111", the drive period T becomes longer correspondingly to D1 as shown in FIG. 2(*h*). In this case, the output of the digital comparator 4*b* is "L", so that there is no output of the one-shot circuit 4*c*. That is, the pulse P is not generated during the period Tp. As a result, current I flows to the output pin for the period T (see FIG. 2(*i*)).

Incidentally, when the control of n grey levels (n is an integer equal to or larger than 5) is performed, the data value, which is a reference data value used in the digital comparator 4*b*, corresponds to a low luminance display data, with which difference in luminance on the display screen is not clear, resolution of the least significant bit of 4 bits is low. Therefore, for higher resolution, the least significant bit is n/4, 1+n/4 or 2+n/4.

When grey level control for luminance of the OEL element is performed by the PWM control and the drive period becomes short, for example, the light emitting time data D2 is "1111" or lower, the peak current is generated in the initial drive time to charge the OEL element or to emphasize luminance. Therefore, even when the time-divisional grey level control is performed by PWM control, low luminance display is emphasized by the peak current.

FIG. 3 is a characteristic line showing a relation between luminance and display data in the grey level control in the above mentioned case in which ordinate is luminance and abscissa is display data value. As shown by the characteristic curve in FIG. 3, in the range in which luminance is "1111" or lower, the tilting of the characteristic line becomes small by the initial charge of the OEL element due to the peak current.

Incidentally, this characteristics may be corrected such that the low luminance region becomes linear as shown by a dotted line. This is because, during the PWM drive in the state where the OEL element is not initially charged, the line droops below the dotted line in the low luminance region.

INDUSTRIAL APPLICABILITY

Though, in the described embodiment when luminance is low, the peak drive current is generated by supplying the drive current of the current output circuit 6 and the output current of the peak current output circuit 7 to the output pin simultaneously. It is possible to drive the OEL element by only the peak current output circuit 7 when luminance is below a predetermined luminance.

The display data/light emitting time data converter 13 is not limited to the ROM, and the display data DATA may be converted into light emitting time data by a program processing by the MPU. Further, the display data/light emitting time data converter may be provided within each of the current drive circuits 1 correspondingly to the respective output pins.

Further, though, in the described embodiment, the data setting and the control of the respective circuits of the current drive circuit 1 are performed by using the MPU, it is of course possible to use a controller, etc., instead of the MPU. Further, though, in the described embodiment, the display color is not specially described, it is of course possible to realize a color organic EL drive circuit by providing the current drive circuits 1 for the output pins correspondingly to R, G and B display colors. Incidentally, the output pins may be pads or bumps formed in the IC chip.

DESCRIPTION OF REFERENCE NUMERALS AND SIGNS

Figure 1:
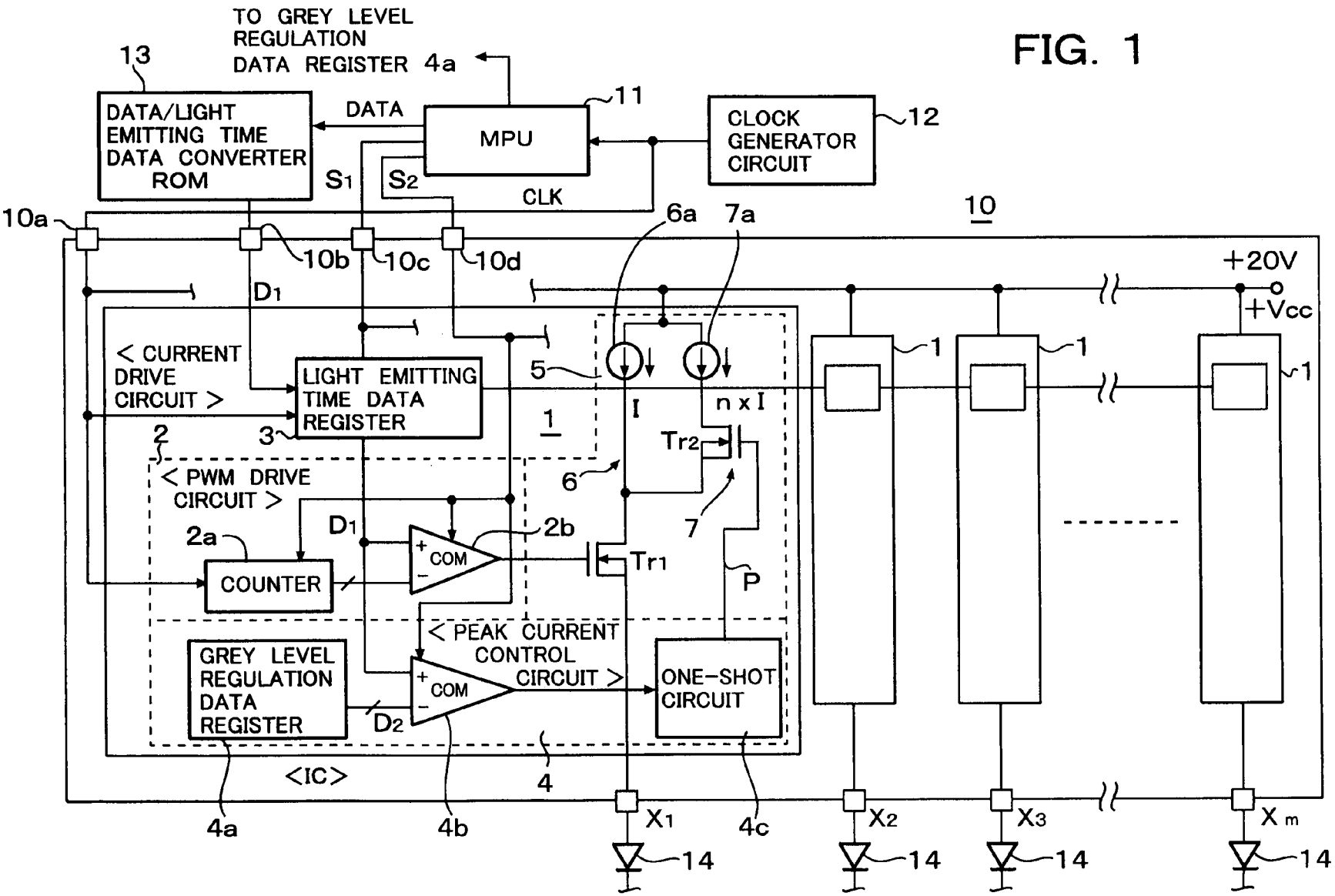
FIG. 1 is a block circuit diagram of a current drive circuit according to an embodiment to which an organic EL drive circuit of the present invention.
Figure 2:
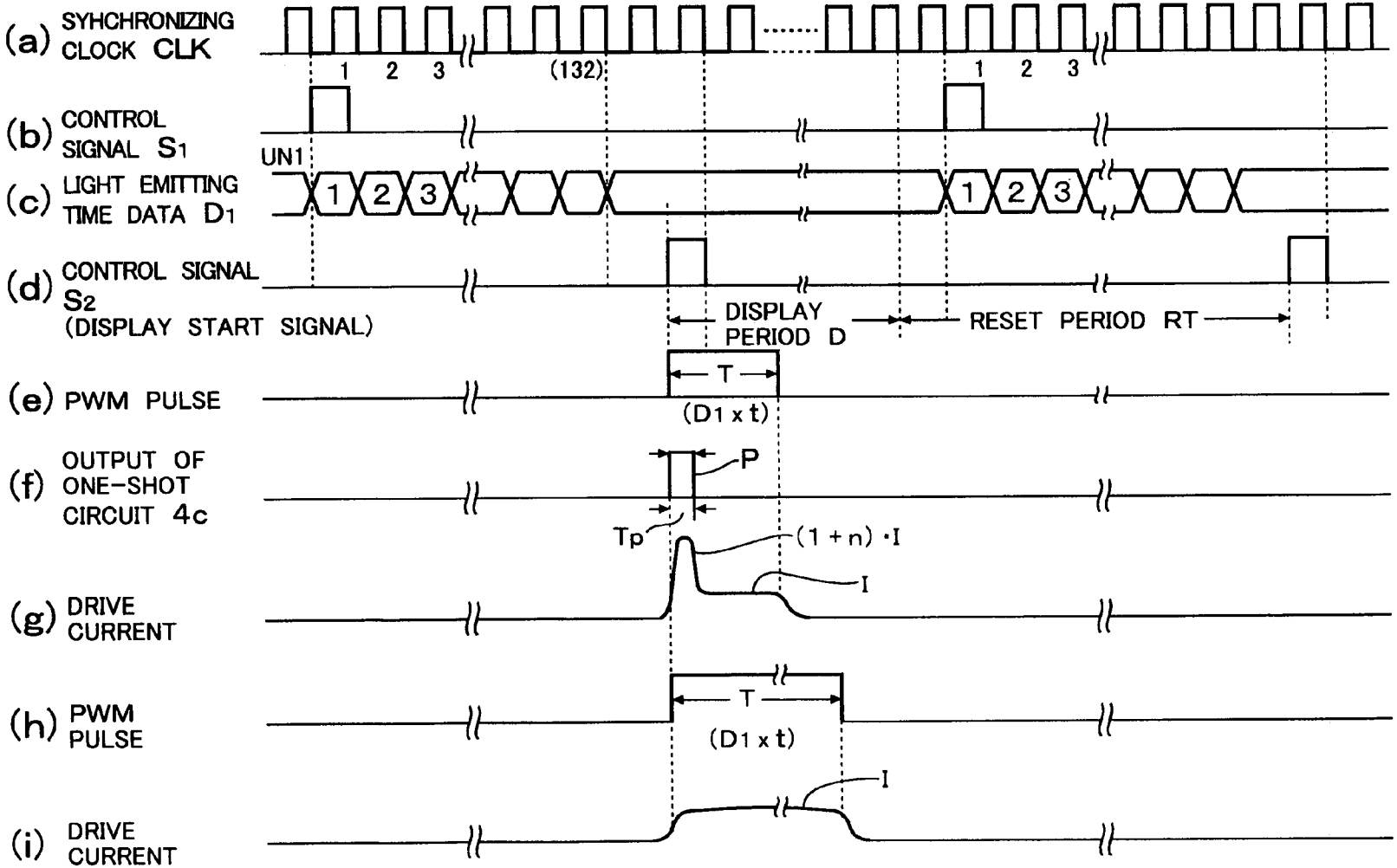
FIG. 2 is a timing chart of PWM drive.
Figure 3:
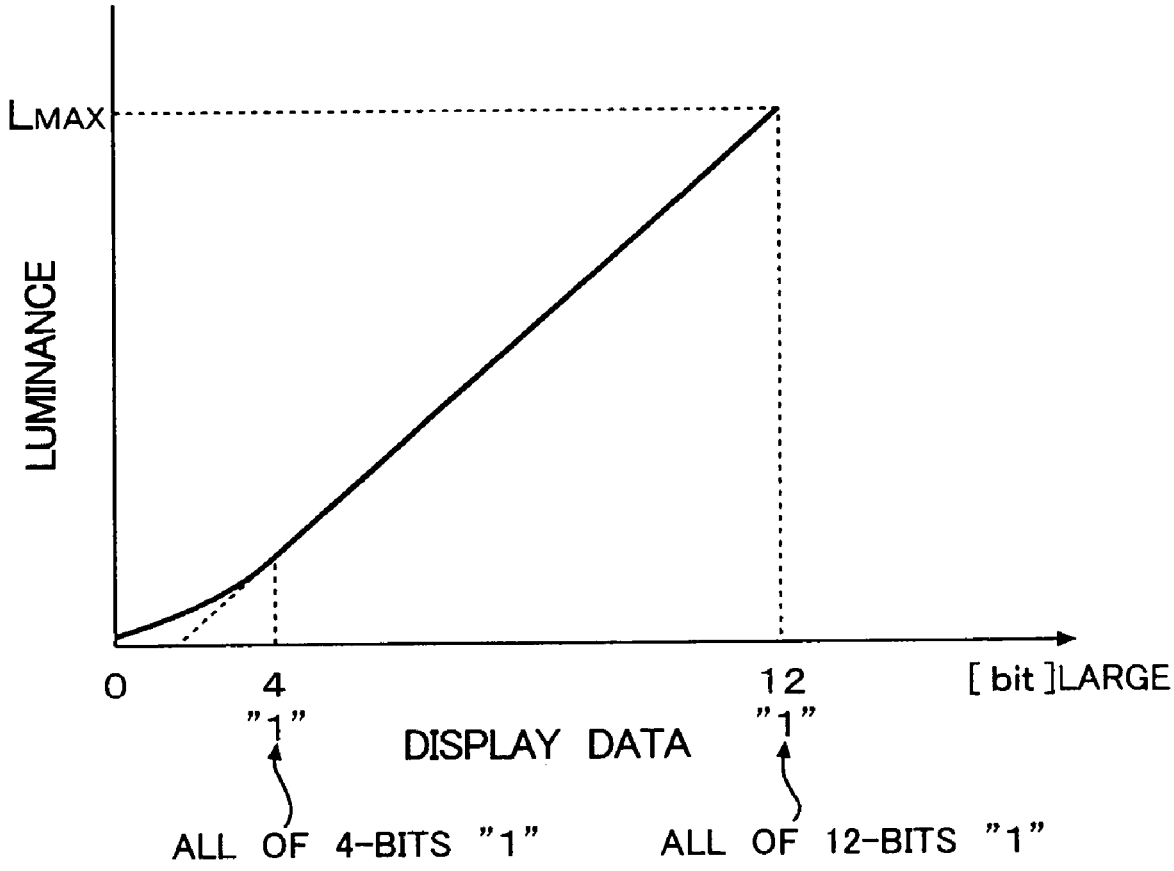
FIG. 3 is a graph showing a grey level characteristics with respect to a display data in the PWM grey level control according to the present invention.

1 . . . current drive circuit, 2 . . . PWM drive circuit, 2*a* . . . counter

2*b*, 4*b* . . . digital comparator, 4 . . . peak current control circuit,

4*a* . . . grey level correction data register, 4*c* . . . one-shot circuit

5 . . . output stage current source, 6 . . . current output circuit

6*a*, 7*a* . . . constant current source, 7 . . . peak current output circuit

10 . . . column driver, 11 . . . MPU, 12 . . . clock generator circuit

13 . . . display data/light emitting time data converter

14 . . . OEL element, X1 to Xm . . . output pin

Tr1, Tr2 . . . N channel MOSFET

The invention claimed is:

1. An organic EL drive circuit including a plurality of current drive circuits, for generating each a PWM pulse having a pulse width corresponding to display data corresponding to luminance of organic EL elements and outputting each a drive current for driving the organic EL elements for a time period corresponding to the PWM pulse, comprising a peak current generator circuit for generating a peak current on the drive current and means for converting the display data into light emitting timing data, wherein the current drive circuit is provided for each of output pins connected to the respective organic EL elements, the peak current generator circuit generates the peak current larger than the drive current corresponding to the display data when a value of the display data is a predetermined value or a value lower than the predetermined value;

wherein the peak current initially charges the organic EL elements or emits light initially when the display data value is the predetermined value or lower; and wherein the current drive circuit includes an output stage current source, the PWM pulse has the pulse width corresponding to the light emitting time data, the output stage current source is driven by the PWM pulse and the predetermined value corresponds to a display data value of low luminance with which luminance difference on a display screen is unclear.

2. The organic EL drive circuit as claimed in claim 1, wherein each of the current drive circuits includes a PWM pulse generator circuit for generating the PWM pulse in response to the light emitting time data corresponding to the current drive circuit.

3. The organic EL drive circuit as claimed in claim 2, wherein each of the current drive circuits includes a first digital comparator for comparing the light emitting time data with light emitting time data corresponding to the predetermined value, wherein the predetermined value is a light emitting time data corresponding to the display data of low luminance and the peak current generator circuit generates the peak current corresponding to the output of the first digital comparator.

4. The organic EL drive circuit as claimed in claim 3, further comprising a clock generator circuit, wherein the PWM pulse generator circuit includes a counter for counting clocks from the clock generator circuit and a second digital comparator for comparing a count value of the counter with the light emitting time data and the PWM pulse generator circuit generates the PWM pulse corresponding to a result of the comparison of the second digital comparator.

5. The organic EL drive circuit as claimed in claim 4, wherein the current drive circuit includes registers having the light emitting time data, the registers of the current drive circuits are connected in series to constitute a shift register and the means for converting the display data into the light emitting time data is constructed with a memory and provided for the current drive circuits commonly.

6. The organic EL drive circuit as claimed in claim 5, wherein the current drive circuit includes a one-shot circuit for receiving the output of the first digital comparator, the output stage current source includes an output transistor, which is turned ON correspondingly to the PWM pulse, for outputting the drive current and a transistor connected in parallel to the output transistor to generate a peak current and the transistor for generating the peak current is kept ON for a constant time period by the output of the one-shot circuit.

7. An organic EL display device comprising an organic EL drive circuit as claimed in claim 1.

* * * * *